US006651345B1

(12) United States Patent
Adachi

(10) Patent No.: US 6,651,345 B1
(45) Date of Patent: Nov. 25, 2003

(54) NON-SLIP SCISSORS

(76) Inventor: Hidemi Adachi, 489-1 Hiromi, Seki-shi, Gifu-ken (JP), 501-3263

( * ) Notice: Subject to any disclaimer, the term of this patent is extended or adjusted under 35 U.S.C. 154(b) by 0 days.

(21) Appl. No.: 09/857,237

(22) PCT Filed: Sep. 29, 1999

(86) PCT No.: PCT/JP99/05381

§ 371 (c)(1),
(2), (4) Date: Jun. 1, 2001

(87) PCT Pub. No.: WO00/43172

PCT Pub. Date: Jul. 27, 2000

(30) Foreign Application Priority Data

| | | |
|---|---|---|
| Jan. 22, 1999 | (JP) | 11-014634 |
| Feb. 19, 1999 | (JP) | 11-041498 |
| Feb. 22, 1999 | (JP) | 11-043138 |
| May 19, 1999 | (JP) | 11-137998 |
| Aug. 6, 1999 | (JP) | 11-223710 |

(51) Int. Cl.[7] ..... B26B 13/08; B26B 19/22
(52) U.S. Cl. ..... 30/195; 30/233; 30/131
(58) Field of Search ..... 30/195, 254, 30, 30/223, 131, 134, 357, 351, 233

(56) References Cited

U.S. PATENT DOCUMENTS

| | | | | | |
|---|---|---|---|---|---|
| 297,964 | A | * | 5/1884 | Bateman | 30/233 |
| 1,903,257 | A | * | 3/1933 | Dahl | 30/131 |
| 2,558,264 | A | * | 6/1951 | Metcalf | 30/195 |
| 3,250,001 | A | * | 5/1966 | Cercone | 30/195 |
| 5,107,591 | A | * | 4/1992 | Sato | 30/195 |
| 6,141,877 | A | * | 11/2000 | Suetsugu | 30/195 |

FOREIGN PATENT DOCUMENTS

| | | |
|---|---|---|
| JP | 47-16258 | 2/1972 |
| JP | 54-132891 | 8/1979 |
| JP | 60-108276 | 7/1985 |
| JP | 60-141573 | 9/1985 |
| JP | 4-273083 | 10/1992 |
| JP | 5-76474 | 12/1993 |
| JP | 6-236485 | 9/1994 |
| JP | 9-165039 | 6/1997 |

* cited by examiner

*Primary Examiner*—Hwei-Siu Payer
(74) *Attorney, Agent, or Firm*—Perkins, Smith & Cohen; Jerry Cohen

(57) ABSTRACT

Provided is scissors for hair cutting or hair dressing, wherein substantially linear slits provided at the edge of the scissors are formed in a slit width that is equal to or smaller than predetermined thickness of a hair, the slits being serially provided along the edge with predetermined intervals. According to these scissors, when the hair is cut, a non-slip effect on hair is obtained, and this slip-free state can be maintained in spite of sharpening. In addition, a proper closing feeling free of strong resistance can be obtained during scissors closing operation. In particular, in the cutting shears, natural finish is possible as required. Alternatively, the slit is formed in length that does not overreach the frictional sliding face of the scissors, and is formed in a slit width that exceeds predetermined thickness of a hair and that is smaller than twice of the predetermined thickness. In this manner, the hair can be cut in a state in which not-slip works in the slits in a way similar to the above, and some hairs enter the slit, and cut in the slit. The hair cut in the slit slips off from this slit, and is free of being clogged, enabling smooth closing operation and reliable straight line alignment.

14 Claims, 24 Drawing Sheets

NON-SLIP SCISSORS

TECHNICAL FIELD

The present invention relates to an improvement of scissors for hair cutting or hairdressing such as cutting shears or thinning shears. In particular, the present invention relates to scissors in which, when the hair is cut or thinned, non-slip is applied so as to prevent hair from slipping at the edge of the blade of scissors in which such a non-slip effect is not degraded by sharpening of the scissors, naturally finished hair is obtained, and the improved cutting performance and abrasion resistance can be obtained.

BACKGROUND ART

When the hair is cut by cutting shears for hair cutting or hairdressing, as shown in FIG. 34, there occurs a phenomenon that hairs sandwiched between two blades 102, 102 slip from the heel of the blades in the point direction. Thus, the hair cutting quantity is reduced by such slip.

In addition, when a cut trace is aligned transversely in a straight line, the hair cutting is not aligned in a predetermined transverse line. As shown in FIG. 35, the cut trace is curved, which is inconvenient.

In the case where the hair is aligned in a straight line by means of the cutting shears, the straight line of the cut trace stands out too much. Therefore, this straight line is shaded, whereby natural finish is sometimes done.

However, even in the case where such linearly cut trace is shaded, straight line alignment using the cutting shears is performed as preprocessing. Then, the hair aligned in this straight line is thinned, the cut trace is shaded, and natural finish is done. Therefore, two types of scissors, cutting shears and thinning shears are used, which is cumbersome. Moreover, in such preprocessing, i.e., straight line alignment using the cutting shears, the hair is hardly aligned in a straight line. Thus, the hair must be cut many times in order to align the hair in a straight line, which is cumbersome.

In order to eliminate this inconvenience relevant to this slippage, as shown in FIG. 36,there is provided cutting shears 201 in which sectional V shaped or U shaped concave ridges 202 are continuously provided at the edge of the blade, whereby V shaped or U shaped waves are repeatedly provided to form a serrated blade shape. According to the scissors, hair is captured by concave ridges 202 of the blade, and does not slip. Thus, the problem with the above described slippage is eliminated.

The problem with hair slippage occurs with thinning shears similarly. The hair can be hardly thinned well because the hair slips while it slips at the edge of the thinning blade. In order to solve the above problem, as shown in FIG. 37 and FIG. 38, there are provided thinning shears in which V shaped or U shaped concave ridges 202 are provided at the edge of the thinning blade. According to the thinning shears, hair is captured by the concave ridges of the edge, and does not slip. Thus, the above described problem with hair slippage is eliminated.

In general, as scissors are repeatedly used, their cutting performance is degraded. Thus, the scissors are used while they are sharpened as required. Specifically, as indicated by alternate long and short dash lines in FIG. 39, a portion close to the edge of the blade is sharpened. However, sharpening such portion close to the edge of the blade shaves the concave ridges 202 formed at the edge, and. there disappear V shaped or U shaped concave ridges 202 shown in FIG. 36 to FIG. 38. In practice, the concave ridges 202 disappear, and a linear edge is obtained by performing such sharpening only one or two times. As a result, there is a problem that the hair that has not been slipped starts slipping.

In addition, in either of the cutting shears and the thinning shears as well, when the edge is formed in a V shape or U shape, the hair is captured by the concave ridges, thus forming a lock. Extra force is required when the scissors are closed to cut such locks. In addition, strong resistance is felt, and touch sense is impaired, which is not preferred in workability.

On the other hand, in general, scissors are often made of stainless having the hardness of about 650 Hv. The higher hardness improves the cutting performance more significantly. When in use, the excellent cutting performance is obtained, and strong wear and tear resistance is obtained. In general, the upper limit of the obtained hardness of stainless is about 800 Hv. As a material that exceeds this limit, there is provided a hard tool material of which the hardness of about 1000 Hv to 1500 Hv or about 2000 Hv can be obtained. However, the blade made of a material with the higher hardness becomes weaker, nicks in the edges are likely to occur. Thus, the edge angle is increased, thereby preventing such nicks in the edges. However, when the edge angle is increased in scissors, the blade hardly cuts into hair, and the hair easily slips. As a result, the slip of the, hair when the scissors are closed becomes significant, and the scissors do not function well. Therefore, scissors made of such material with the high hardness is not provided.

At present, scissors having the hardness of about 700 Hv are partially provided. This hardness is defined as the upper limit required to function as scissors in view of the presence or absence of slip. If the scissors are made of stainless having the hardness of 800 Hv, the cutting performance is improved. Further, if the scissors are made of a hard tool material with the ultra-high hardness, the cutting performance and wear and tear resistance is improved more significantly. On the other hand, there is a problem that the slip due to hair slippage becomes extremely significant, which is impractical. In particular, when the scissors are made of a hard tool material, the wear and tear resistance is expected to be about 10 times as high as conventional scissors. Although such scissors are ideal in cutting performance and wear and tear resistance, the hair slips more easily, which is impractical.

The objective of the present invention is to provide scissors in which non-slip is applied to the hair or such a non-slip state can be maintained irrespective of sharpening, a proper closing feeling is obtained, the feeling being free of strong resistance in scissors closing operation, and in particular, a required natural finished cut can be achieved in cutting shears, the scissors having excellent cutting performance and wear and tear resistance.

DISCLOSURE OF THE INVENTION

According to the present invention, there is provided scissors in which substantially linear slits or the like that cut out at the edge of a blade or blades are serially provided along the edge, and, by assuming a hair with predetermined thickness, a variety of slit widths of the slits are defined when the hair thickness is defined as a reference.

First, as shown in FIG. 1 to FIG. 3, a slit is defined as a slit width that is equal to or smaller than the predetermined thickness of a hair. Namely, the width of the slit is provided to be smaller than or equal to the thickness of hair. The scissors may be cutting shears or thinning shears and any other shape.

In this manner, if the slit is smaller than the thickness of a hair, as shown in FIG. 4, hair X is caught by opening 4 of slit 3, which functions as non-slip. In addition, the slit is equal to the thickness of the hair, the hair is caught similarly, which functions as non-slip. Alternatively, as shown in FIG. 5, one or two hairs X enter the slit, and are stuck in the slit. Namely, the hairs are clogged at the opening, which functions as non-slip for the hair.

Moreover, in these scissors, as indicated by alternate long and short dash lines in FIG. 6, even if the edge is sharpened and retracted, slit 3 is not eliminated as illustrated, and a non-slip effect continues to the end.

Although the above slits may be formed (manufactured) in any way, these slits can be formed as an example by grinding wheels with the thickness equal to the slit width of each of the slits. If a thin slit and a slit thicker than the slit are formed, two types of grinding wheels that correspond to these slits are provided for grinding.

If the thickness of a hair is smaller than predetermined thickness, such hair cuts into a slit. To prevent this, the slit is formed to the length that does not overreach the frictional sliding face of the scissors. In this manner, the blade is formed while the bottom of the slit crosses the frictional sliding face. Thus, the hair that has entered the slit can be cut at the bottom of the slit.

Here, the frictional sliding face S denotes a face provided at the back side of the edge. This face is provided for the reasons stated below.

In general, although a sectional shape of the blade back of the scissors has a slightly concave, curved face called back space P, as shown in FIG. 40, flat frictional sliding face S is formed only in the vicinity of the edge. This is because, when the scissors are operated to be opened or closed, a cutting action is obtained due to the sliding of frictional sliding faces S of both of the blades. The back space P is curved to be concave so as to prevent blade backs other than frictional sliding faces from coming into contact with each other. Therefore, as shown in FIG. 11 and FIG. 12, slit 5 is defined in length such that slit bottom 6 is caught by frictional sliding face S, and does not overreach frictional sliding face S. In the case where a hair with the thickness smaller than predetermined thickness enters the slit, the slit is formed in length that does not overreach frictional sliding face S of the scissors in order to provide blade 7 for cutting this hair on the bottom of blade 7. Which of the slits is formed in length that does not overreach the frictional sliding face is arbitrary. For example, in the case where large and small widths of slits coexist, slit 5 with the large width is such that a thin hair is likely to enter the slit to depths. Thus, when a blade is provided at the bottom of this slit, even if a hair cuts into the slit, such hair can be cut.

In addition, as another scissors, a slit is formed to be greater than the predetermined thickness of a hair and to be less than twice of the thickness of the hair. In order to form a blade at the bottom of the slit, the slit is formed in length that does not overreach the frictional sliding face. For example, the slit width is less than twice of the thickness of hair.

Even if the slit width is greater than the thickness of a hair, there can be achieved an effect that hairs are caught by the opening of this slit during closing operation of the scissors, and a non-slip effect is achieved. This is deemed to be because, when the scissors are closed, a number of hairs are collected at the opening of the slit, and thus, even if the opening is wider than the thickness of the hair, the densely collected hairs are caught so as to close the opening.

In addition, in these scissors, even in the case where hairs enter the slit, the width of the slit is widened. Thus, hair slip becomes proper, and no hair is clogged in the slit.

Therefore, according to these scissors, hair can be cut while non-slip is applied in the slit, and partial hairs enter the slit, and are cut therein. The hairs cut in the slit slip off from this slit, and are not clogged, thus enabling smooth closing operation and reliable straight line alignment.

As still another scissors, a predetermined width of the slit is formed such that some hairs enter a longitudinal column. The slit is formed in length that is within the frictional sliding face of the blade similarly.

According to these scissors, since the width of the slit increases; a quantity of hairs captured in the slit increases. However, since some hairs are cut in a longitudinal array, unlike conventional scissors, no strong resistance is felt, enabling smooth closing operation.

Therefore, "a predetermined slit width where some hairs enter a longitudinal column" is determined as follows.

The closing resistance of scissors is caused by the length of grips of the scissors, the length of the blades, cutting characteristics of the edge. Finally, in addition to these factors, the resistance is determined depending on a quantity of hairs captured by the slit. The slit width determines a quantity of hairs to be captured in the slit (namely, the longitudinal column of hairs), whereby the resistance or smoothness when hairs are cut is determined.

Therefore, the "predetermined slit width when some hairs enter a longitudinal column" is referred to as a slit width in which, even if hairs captured in the slit are cut, there can be obtained a smooth closing resistance to an extent that a resistance is eliminated such that a lock of hairs is cut when the thinning shears are used. Thus, as long as the smoothness of closing operation is obtained, the slit width may be as wide as 0.4 mm to 0.5 mm or the like.

A "longitudinal" of the longitudinal column denotes a longitudinal direction of slit 3. The thickness of hair is 0.05 mm to 0.08 mm as an example. Thus, the slit of 0.2 mm to 0.25 mm in width can be exemplified. In this case, three or four hairs can enter a longitudinal column as an example.

In the case where the slit is formed in length that does not overreach the frictional sliding face, whereby the slit bottom crosses the frictional sliding face to form a blade, such crossing is formed at an acute angle (refer to FIG. 17), whereby proper cutting performance can be obtained.

If slits are ground by grinding wheels, the slit bottom is formed as a grinding trace. Thus, a way of addressing the grinding wheels relevant to the scissors may be set so that the edge angle of the slit bottom is acute.

As shown in FIG. 32, the longitudinal direction of slit 3 is defined to be substantially vertical to edge Kb of the counterpart blade at each cross point C of the scissors.

As in scissors with the slit width equal to or smaller than predetermined thickness of a hair or like scissors with the slit width exceeding and being smaller than the predetermined thickness of a hair, if a non-slip effect is intended, one end 4' of the opening of the slit is at an acute angle. Thus, a catching effect increases, and a non-slip effect is improved.

In addition, when the slit width is defined in a predetermined width in which some hairs enter a longitudinal column, and is intended to cut the captured hairs by the slit, a linear blade of the counterpart blade is cut down to the hairs arranged in a longitudinal column in the slit. Thus, the improved cutting performance and the improved smoothness of closing operation can be obtained.

In any of the above described scissors as well, a "portion at which the slits are serially provided" may be arbitrarily disposed along the edge. Namely, the slits may be serially provided over the full length of the blade or may be serially provided partly of the full length of the overall blade. For example, the slits may be serially provided at only a portion close to the point of the blade, and a general linear blade may be formed at the other portion. Alternatively, the slits may be serially provided at only a portion close to the heel of the blade or may be serially provided at any portion. In addition, the serially provided portion may be roughly or finely provided at the slit.

Depending on the presence or absence of such serially provided portion, the edge of the scissors is divided into a portion at which hair is cut without slippage and a portion at which hair is cut with slippage, corresponding to the presence or absence of the serially provided portion. The presence or absence of such slippage is brought onto the edge line. Thus, the hair cut trace is not linear, waves corresponding to disposition of the "serially provided portion" are irregular, and natural change in finish is obtained.

In addition, at the serially provided portion, the large and small gaps of the slits can be differentiated with such each portion, an extent of the "non-slip" depends on this difference. Thus, the hair cut trace becomes irregular as in waves corresponding to the large and small gaps, as shown in FIG. 21. In addition, with respect to one serially provided portion as well, equal pitches are provided at that portion or the large and small gaps may be provided with unequal intervals.

Likewise, arbitrary disposition of the "portion at which slits are serially provided" at the edge and the large and small gaps of the slit at the serially provided portion are used altogether, whereby various finishes of hairs can be obtained. Alternatively, there may be provided scissors in which either one of arbitrary disposition and the large and small gaps of the slit are achieved without using them.

In any of the above described scissors, shallowly cutout, substantially concave engagingly fit slits may be serially provided instead of the slits (FIG. 33). This engagingly fit slits denote a slit providing engagingly fit to an extent that hairs serve as non-slip at a concave ridge that is more recessed than the edge rather than a slit formed in a shape in which-hairs enter a slit.

In addition, as described in the Background of the Invention section, hair slip significantly when a material of the scissors has the predetermined hardness or more. Thus, such material with high hardness has not been used. However, according to the present invention, a non-slip effect is achieved, and such material with high hardness can be used as a material of the scissors. As a result, the improved cutting performance, wear and tear resistance, and the non-slip effect can be achieved by a pair of scissors, and a very excellent pair of scissors can be obtained.

In particular, the aforementioned effect becomes more significant by using a hard tool material for the scissors.

Specific examples of material include: stainless of about 800 Hv in hardness or high-speed tool steel and the like. Examples of hard tool materials include powder metallurgy high-speed tool steel, ultra-fine particles, cemented carbide, cermet, sintered ceramics, cubic boron nitride (CBN) or the like.

The scissors assume that two blades are made of materials with the hardness identical to each other. In order to maintain the scissors cutting performance, a magnitude difference in hardness of the blade material is provided between these two blades opposite to each other, and slits may be provided at only the blade with the high hardness.

The reason is stated as follows. In general, the scissors in use is subjected to hair grease at the edges. When the slide faces of the two blades with the differential hardness are covered with grease film, this grease serves as sharpening lubricant on the frictional sliding faces. When the scissors are operated to be opened and closed, there can be achieved an effect that the frictional sliding face on the high hardness side sharpens the frictional sliding face on the low hardness side. Thus, the scissors is sharpened at the same as when in use, and therefore, the blade on the low hardness side can maintain a state in which its edge is always sharpened. In addition, the blade on the high hardness side originally has a wear and tear resistance, and the siding counterpart is a blade with the low hardness. Therefore, the blade on the high hardness side is less worn. Shortly, there is provided scissors in which both of the blades are always kept sharpened, and a proper cutting performance is maintained.

For example, there is a method in which one blade is made of ceramics, slits are formed on the blade, and the other blade is made of stainless (for example, 650 Hv in hardness). Alternatively, the blades may be made of cermet or stainless and any other material combination. If the wear and tear velocity of the blade on the low hardness side is high, the magnitude difference in hardness between the blades is reduced. Conversely, if the wear and tear is low, and there cannot be achieved a sharpening effect on the blade on the low hardness side, materials may be selected in order to expand the magnitude difference in hardness.

BEST MODE FOR CARRYING OUT THE INVENTION

Figure 1:
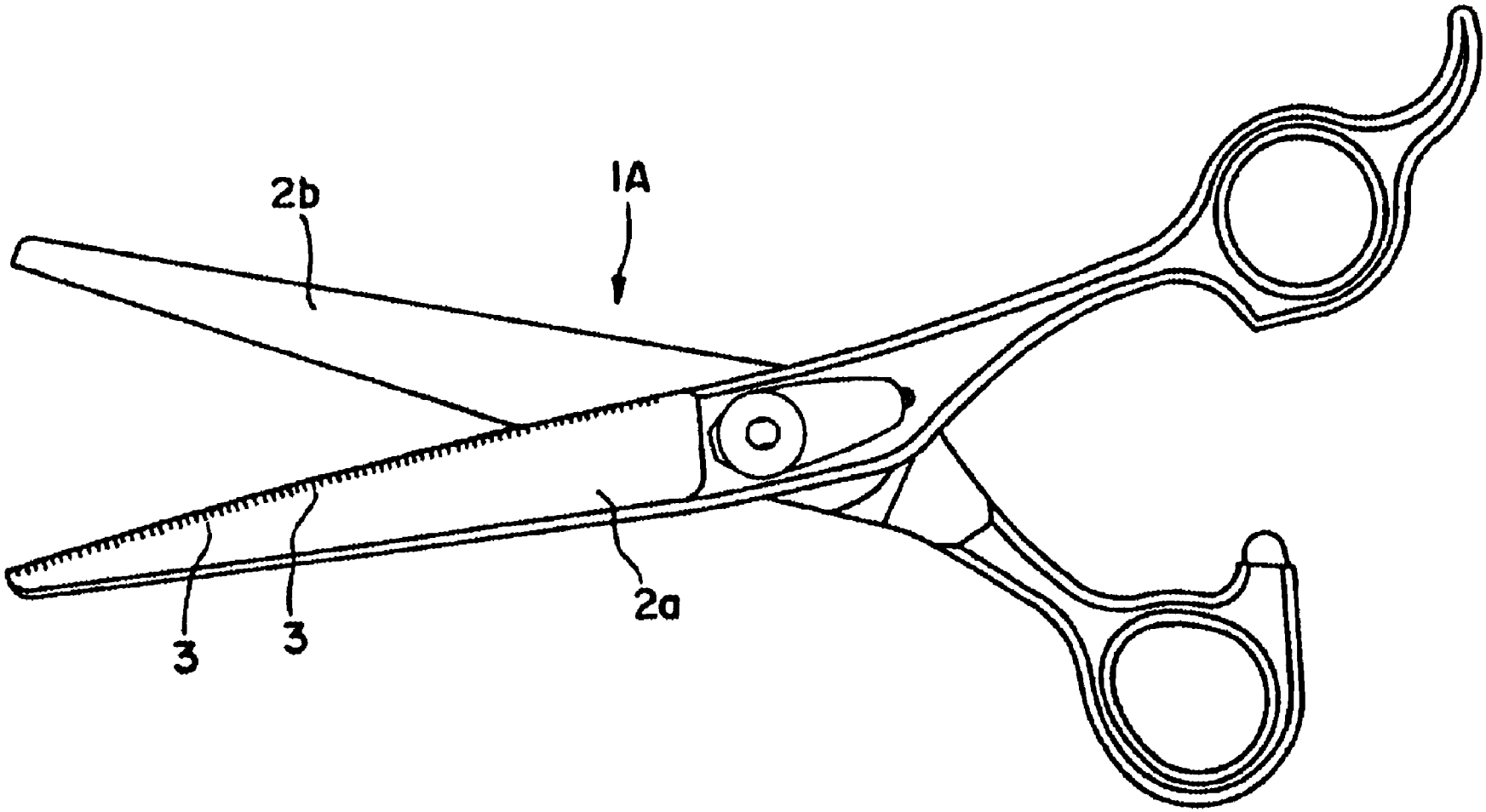
FIG. 1 is a view showing cutting shears according to the present invention, wherein slits are formed at one blade with equal pitches.
Figure 2:
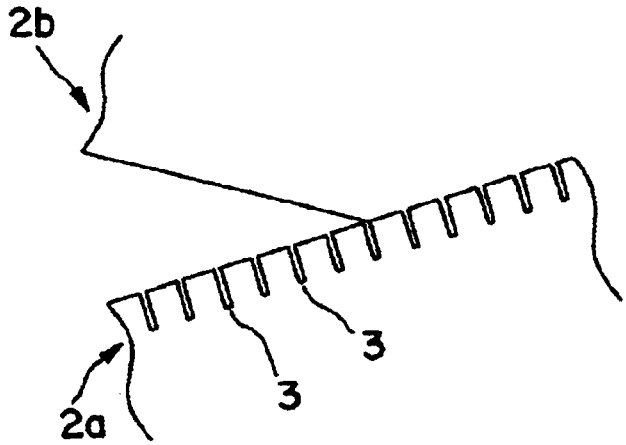
FIG. 2 is a partial enlarged view of FIG. 1.
Figure 3:
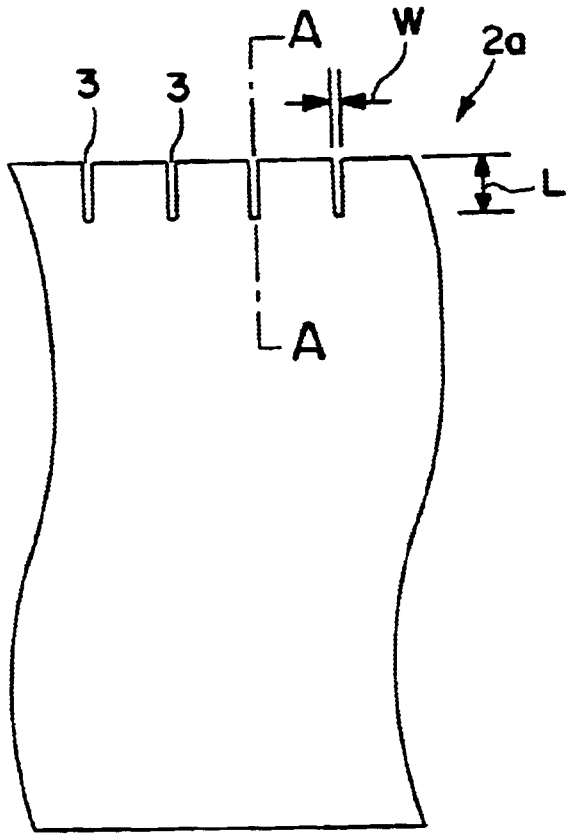
FIG. 3 is a partial enlarged view showing a blade for illustrating slits.

In cutting shears 1A shown in FIG. 1; slits 3, 3, . . . with their equal pitches are provided at one side 2*a* of two blades 2*a* and 2*b* over the full length of blade 2*a*. These slits 3 are shaped and disposed as shown in FIG. 2 and FIG. 3. A slit width W is defined to be about 0.04 mm to 0.05 mm, assuming that a hair has thickness of 0.08 mm. A slit length L is defined to be about 1.0 mm, and a pitch width between the slits is defined to be about 1.0 mm.

Figure 4:
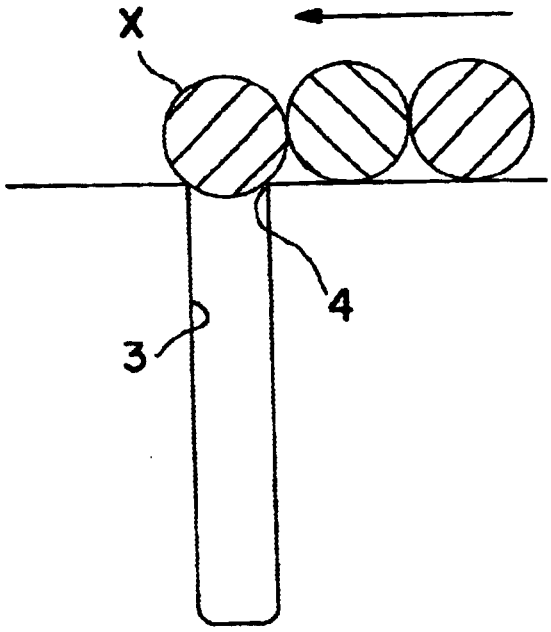
FIG. 4 is a view illustrating a case in which hairs are caught by the opening of a slit, which serves as non-slip.

In manufacture of cutting shears 1A, grinding wheels with the thickness corresponding to the slit width W are seen vertical to the longitudinal direction of the blades, whereby the slit is ground, such grinding is performed sequentially from the heel to the point of the blade, and the slits 3 are serially provided. In this manner, as shown in FIG. 4, opening 4 of slit 3 is formed acutely with a right angle, and an effect that hair X is caught is achieved. In addition, the slit width is narrower than the thickness of a hair, and thus, a non-slip effect caused by slit 3 is achieved.

Figure 5:
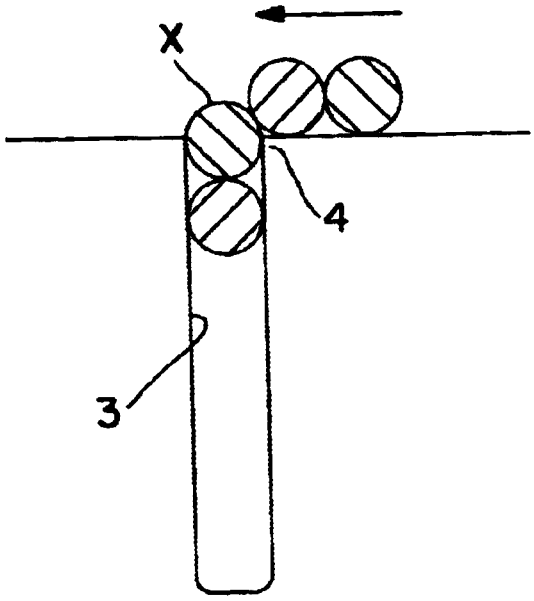
FIG. 5 is a view illustrating a case in which hairs enter a slit.

Further, even if the thickness of a hair is equal to the slit width, such catching effect is achieved similarly. Alternatively, as shown in FIG. 5, the hairs are sandwiched between the slits, which serve as non-slip for hair. If a hair is caught by the opening, another hair is caught by such a hair, and still another hair is caught by such another hair. Thus, the hairs are continuously caught one after another, and a proper non-slip effect is achieved.

Figure 6:
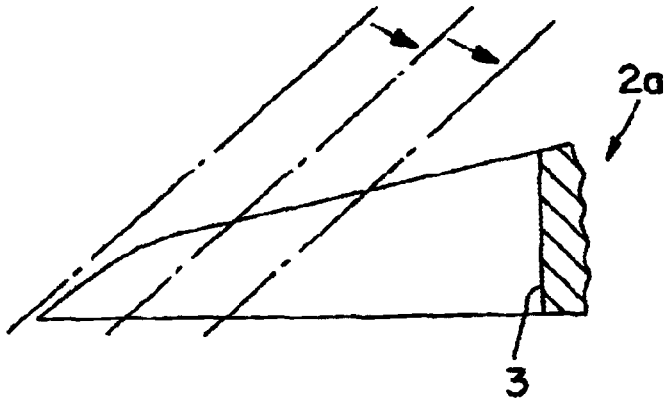
FIG. 6 is a sectional view taken along line A—A, which illustrates that a slit is not eliminated by sharpening.
Figure 7:
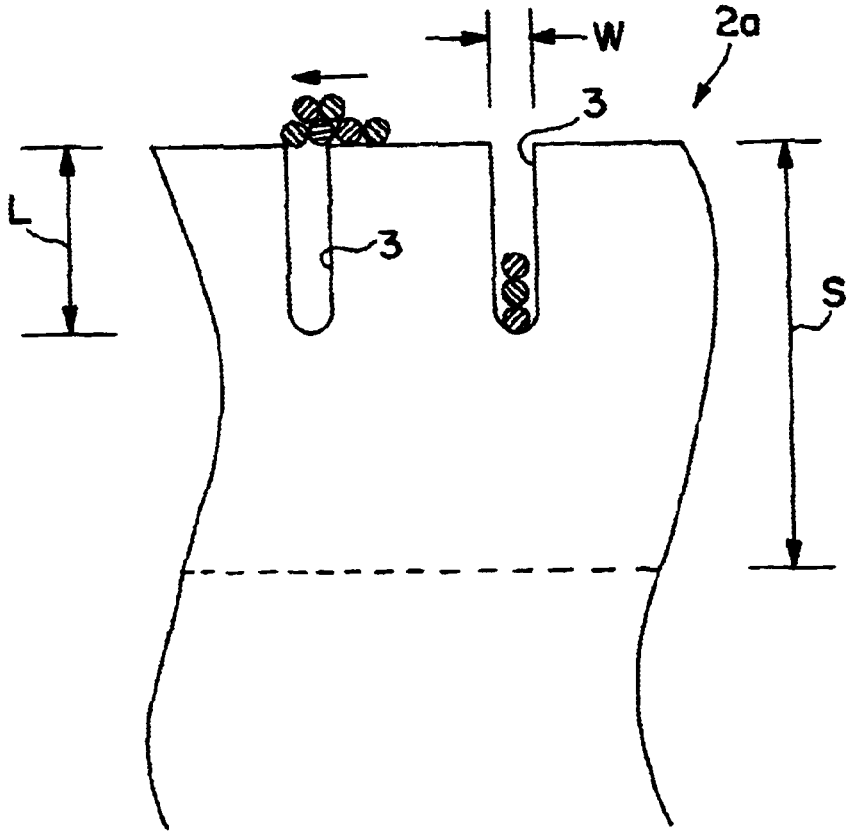
FIG. 7 is a view illustrating a case in which, when the thickness of a slit exceeds the thickness of hair and is smaller than twice of the thickness of hair, hairs have a plenty of margin relevant to the width of the slit.

In addition, if the cutting performance is degraded due to repeated use of the scissors, the blade is sharpened in order to recover the cutting performance. Even if the edge is retracted by such sharpening (alternate long and short dash lines shown in FIG. 6 corresponds to a grinding face), slits 3 are not eliminated, and the non-slip effect continues to the end. Further, even if corners 4 of the opening of the slit are rounded with a repeated use, new corners 4 are formed at the opening by sharpening the edge, making it possible to recover the non-slip effect;

As another example, there is shown scissors 1, assuming a hair of 0.08 in thickness. The external view of the scissors is similar to that shown in FIG. 1. That is, slits 3, 3, . . . are provided at blade 2*a* over the full length of the entire blade, and a linear blade is provided at blade 2*b*. In these scissors, the slit width W is defined to be about 0.1 mm, which is greater than the thickness of a hair (0.08 mm) and smaller than twice of the thickness of the hair. As shown in FIG. 7, the slit width is defined to provide a margin such that hairs are not clogged in the slit. Although frictional sliding face S is defined to be about 1.0 mm in width, slit 3 is defined as a slit length L of about 0.5 mm so as to be included within this frictional sliding face S. In addition, equal pitches of about 0.4 mm are defined between slits 3 and 3. Further, blade 5 at its acute edge angle is provided as shown in FIG. 3.

According to these scissors, as shown in FIG. 7, when the hair is cut, a non-slip effect is obtained at the opening of the slit, slippage is suppressed, and straight line alignment is facilitated. In addition, although some hairs are cut while the hairs enter the slits and are captured by the slits, only one hair is in longitudinal column. Thus, such hairs can be cut without closing resistance.

In particular, although the hairs cut while they are captured by the slits are occasionally sandwiched between the slits, if the hairs are continuously cut, the hairs temporarily sandwiched between the slits easily slip off from the slits in a state in which they are shaken down. Thus, hairs are not clogged in the slits.

In this manner, the above scissors is characterized in that: the scissors works well as non-slip; even if hairs enter slits, the resistance when the scissors are closed is as smooth as conventional scissors; and further, hairs are not clogged in such slits.

Figure 8:
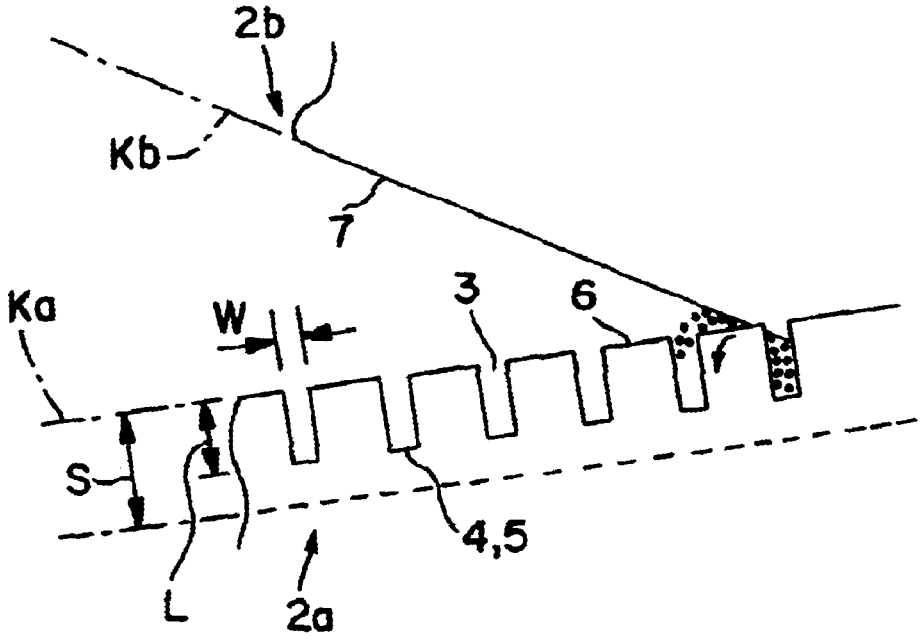
FIG. 8 is a view illustrating a case in which a slit is formed in its predetermined slit width in which some hairs enter a longitudinal column, and the hairs are cut in the slit.

As another example, there is shown scissors, wherein the width of the slits is changed in a predetermined slit width in which some hairs enter a longitudinal column. These scissors are provided at edge Ka of the scissors, as shown in FIG. 8, and the slit width W of slit 3 is defined to be 0.2 mm in which two or three hairs enter in a longitudinal column. In addition, slit length L is about 1.0 mm or less in length in which slit bottom 4 does not overreach frictional sliding face S, and the pitch width is about 1.0 mm.

According to these scissors, while hairs are cut at linear edge portion 6 sandwiched between adjacent slits 3, some hairs are caught by the slits, and are cut therein.

In general, the thickness of a hair is about 0.08 mm in Eastern people, and about 0.06 mm in Western people. The thickness of a particularly thin hair is about 0.03 mm. In the same person, the thickness of hairs is substantially constant, and the range of the thickness is narrow. Therefore, for example, when scissors are used in Japan, the predetermined average thickness of hair of Eastern people is defined as 0.08 mm, and the above various types of scissors may be formed when this thickness is defined as a reference. Alternatively, a variety of slit widths may be provided without being limited to the above.

Figure 9:
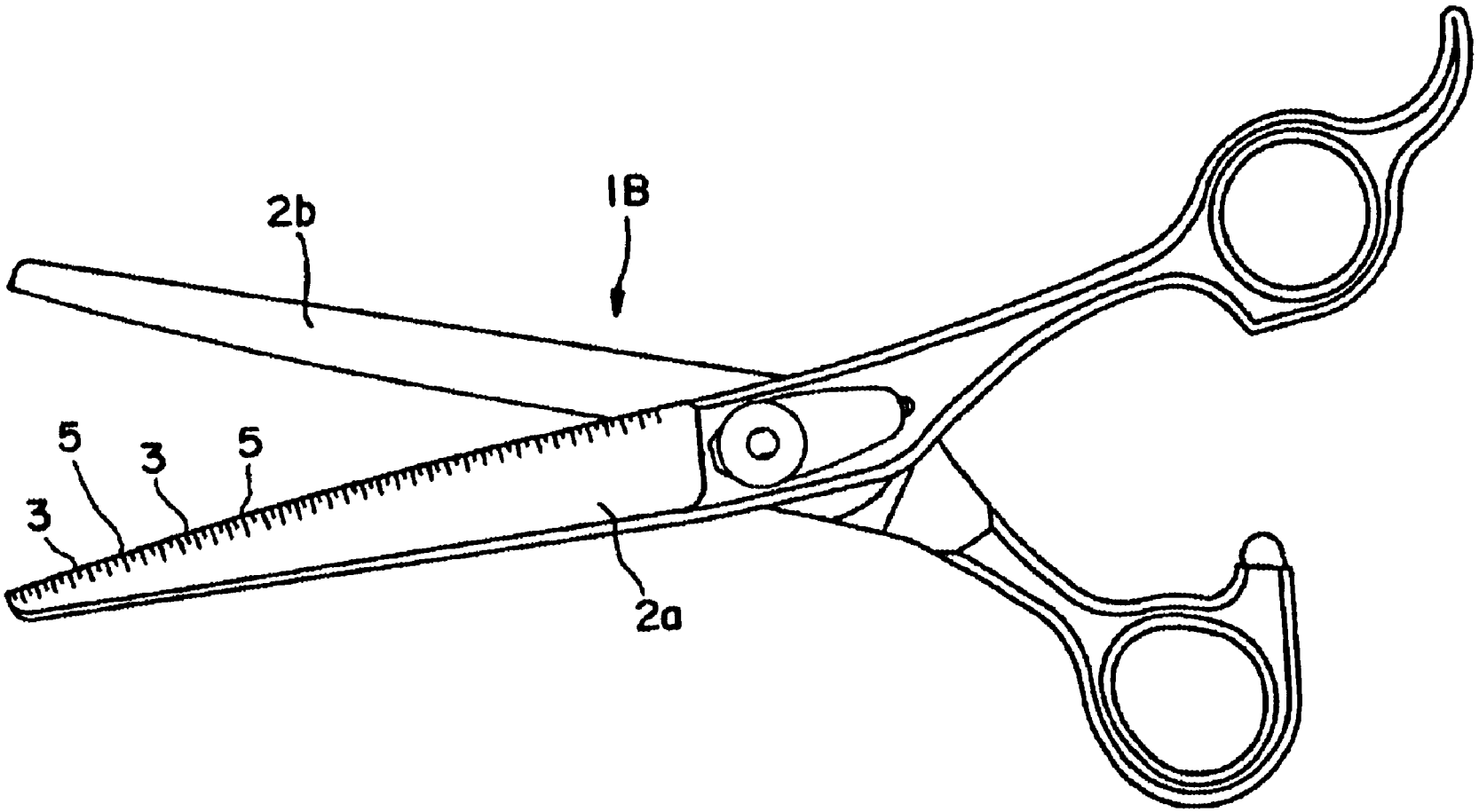
FIG. 9 is a view showing another cutting shears according to the present invention, wherein thin slits and thick slits are repeated alternately with equal pitches.
Figure 10:
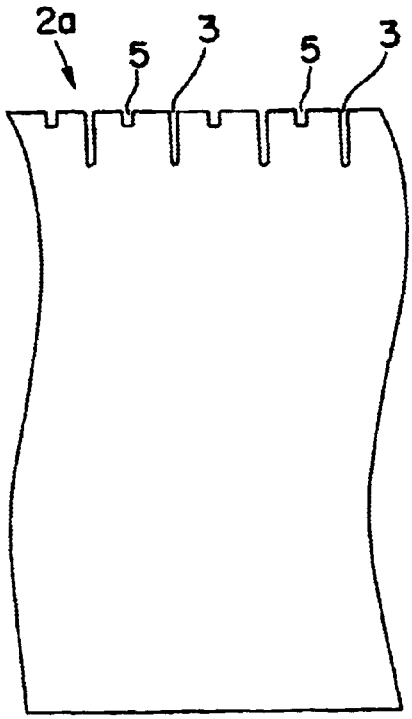
FIG. 10 is a partial enlarged view of FIG. 9.

As another example, in FIG. 9 and FIG. 10, there is shown cutting shears 1B, wherein thin slits 3 and thick slits 5 are serially provided alternately at blade 2*a* with equal pitches. Thin slit 3 is about 0.04 mm to 0.05 mm in slit width, and the slit length is about 1.0 mm or less, which overreaches frictional sliding face S (about 0.5 mm in width) (refer to FIG. 11). In addition, thick slit 5 is about 0.08 mm in slit width, and the slit length is formed to be 0.3 mm to 0.4 mm, which does not overreach the frictional sliding face. These slits are serially provided with pitches of 1.0 mm.

Figure 11:
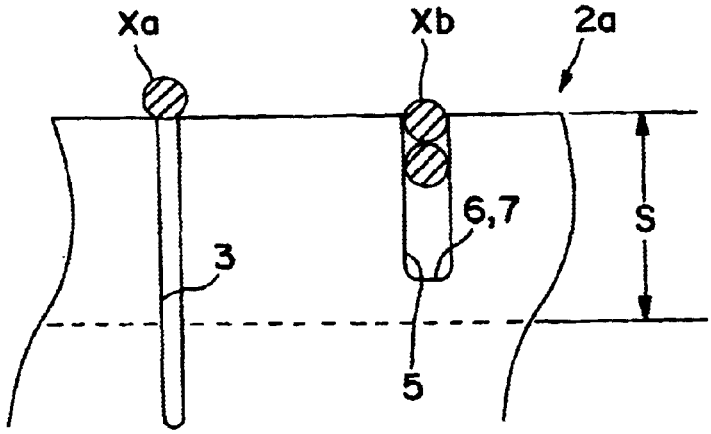
FIG. 11 is a partial enlarged view of FIG. 10, which illustrates how thin slit 3 and thick slit 5 are associated with the thickness of a hair.

In this manner, as shown in FIG. 11, hair Xa is caught by thin slit 3, which serves as non-slip. Alternatively, hair Xb is caught by the thick slit 5, and is clogged, which serves as non-slip. In addition, in the thick slit 5, blade 7 is formed at the slit bottom 6. Thus, even if a hair enters the slit 5, the hair can be cut.

In this manner, when thick slits 5 are provided, they serve as nonslip even if the thickness of hair is larger than an average.

As has been described above, assuming that the thickness of hair is various, the widths of the slits are provided differently in size, making it possible to cope with individual differences in thickness of hair or dispersion in thickness of hair. In addition, cutting slits with their different slit widths coexist arbitrarily, and are serially provided, whereby there can be achieved a cutting performance and a touch sense that differs from those of scissors with only slits with the single width.

In the cutting shears, the slits not only may be serially provided at only one blade as described above, but also may be provided at both of the blades. In addition, after thin slits have been formed at one blade, thicker slits may be formed at the other blade. The width of each slit may be various without being limited to the constant width of each slit, as long as the aforementioned condition is met.

Figure 13A:
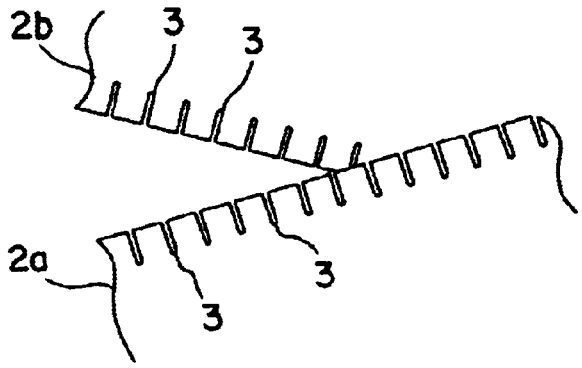
FIG. 13 is a view showing an example when slits are serially provided.
Figure 13B:
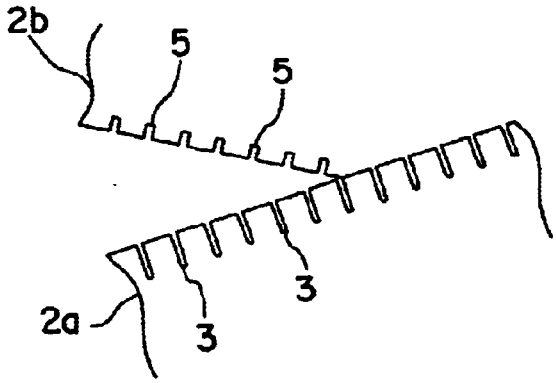
Figure 13C:
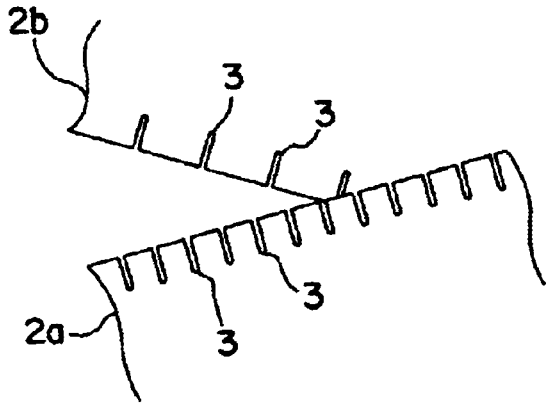

FIG. 13(*a*) to FIG. 13(*c*), FIG. 14(*a*) to FIG. 14(*c*), and FIG. 15 each shows an example when slits are provided at both blades 2*a* and 2*b*, the contents of which are as follows.

In FIG. 13(*a*), thin slits 3 with their equal pitches are provided at both blades 2*a* and 2*b*. In FIG. 13(*b*), thin slits 3 with their equal pitches are provided at blade 2*a*, and thick slits 5 with their equal pitches are provided at blade 2*b*. In FIG. 13(*c*), thin slits 3 with their narrow equal pitches are provided at blade 2*b*, and thin slits 3 with their wide equal pitches are provided at the blade 2*b*. In FIG. 14(*a*), repetition of thin slits 3 and thick slits 5 is provided with equal pitches at both blades 2*a* and 2*b*. In FIG. 14(*b*), thin slits 3 are provided with equal pitches, thick slits 5 provided between thin slits 3 and 3 are disposed alternately by every two thin slits 3. The thin slits 3 and the thick slits 5 are provided at both blades 2*a* and 2*b* with their equal pitches. In FIG. 14(*c*), thin slits 3 are provided with equal pitches, thick slits 5 provided between thin slits 3 and 3 are disposed alternately by every two thin slits 3 at blade 2*b*. Thin slits 3 and the thick slits 5 are provided at blade 2*a* with their wide equal pitches. In FIG. 15, thin slit 5*a* of the same length and thick slit 5*b* with its longer length are provided alternately between thin slits 3 and 3 with their equal pitches, and such arrangement is provided at both blades 2*a* and 2*b*.

Figure 16A:
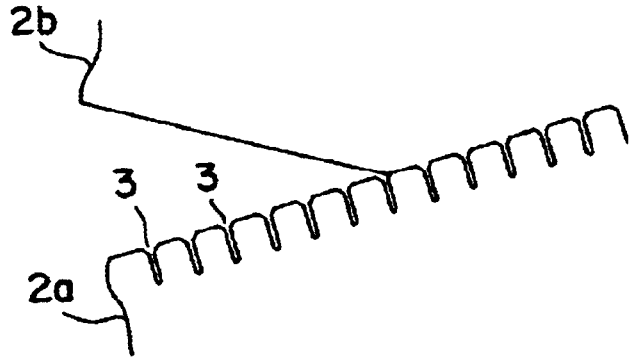
FIG. 16 is a view showing an example when corners of the opening of slits are removed.
Figure 16B:
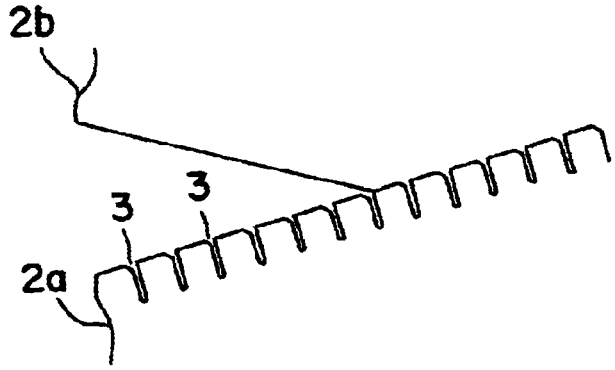
Figure 16C:
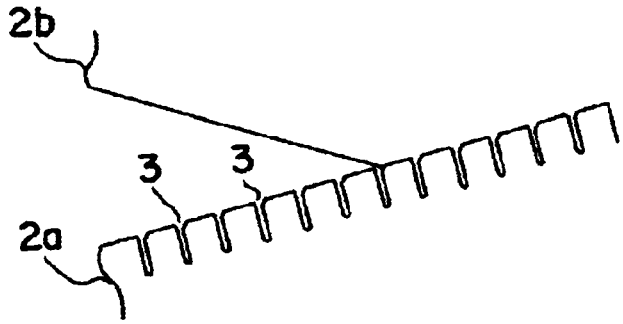

As still another example, in FIG. 16, there is shown a case in which corners of the opening of slit 3 are removed, wherein hairs can be caught by the slit differently. In addition, if there is provided scissors in which hairs are supplemented at the slits, and are cut, the hairs can be supplemented differently.

Figure 14A:
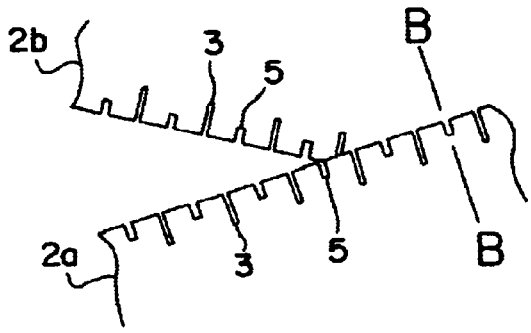
FIG. 14 is a view showing an example when slits are serially provided.
Figure 14B:
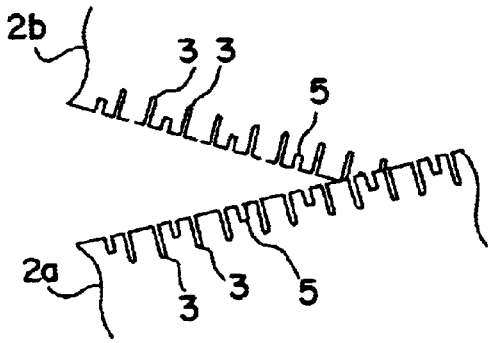
Figure 14C:
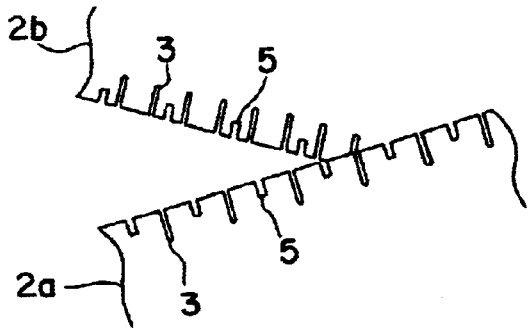
Figure 15:
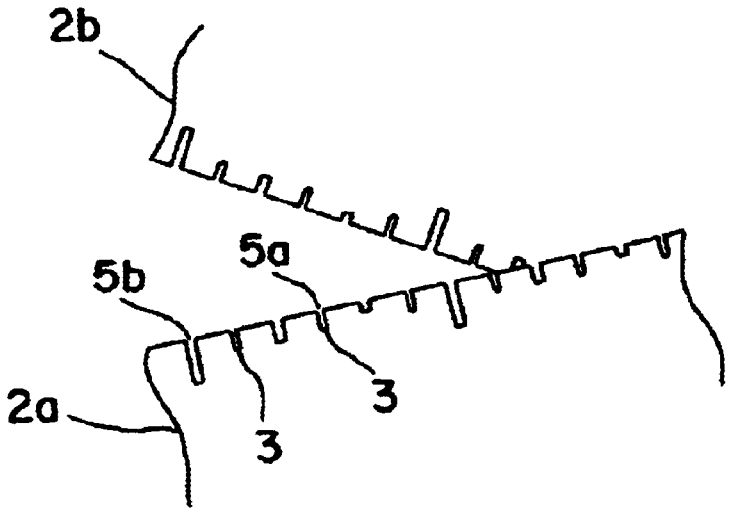
FIG. 15 is a view showing an example when slits are serially provided.
Figure 17:
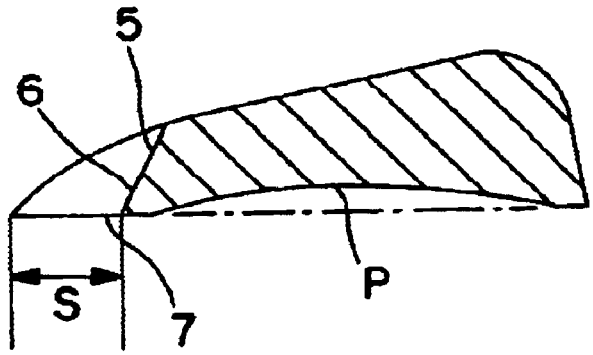
FIG. 17 is a sectional view taken along line B—B of FIG. 14, wherein an acute edge angle is provided at the bottom of a slit.

FIG. 17 is a sectional view taken along line B—B of FIG. 14(*a*) shown as an embodiment according to claim 5, wherein slit bottom 6 of thick slit 5 is formed so as to be caught by frictional sliding face S of the blade back, and moreover, edge 7 with an acute edge angle is provided at slit bottom 6, the possible angle ranging from 15 degrees to 89 degrees. In this manner, the hairs entering the slit bottom of the thick slit can be cut.

Figure 18:
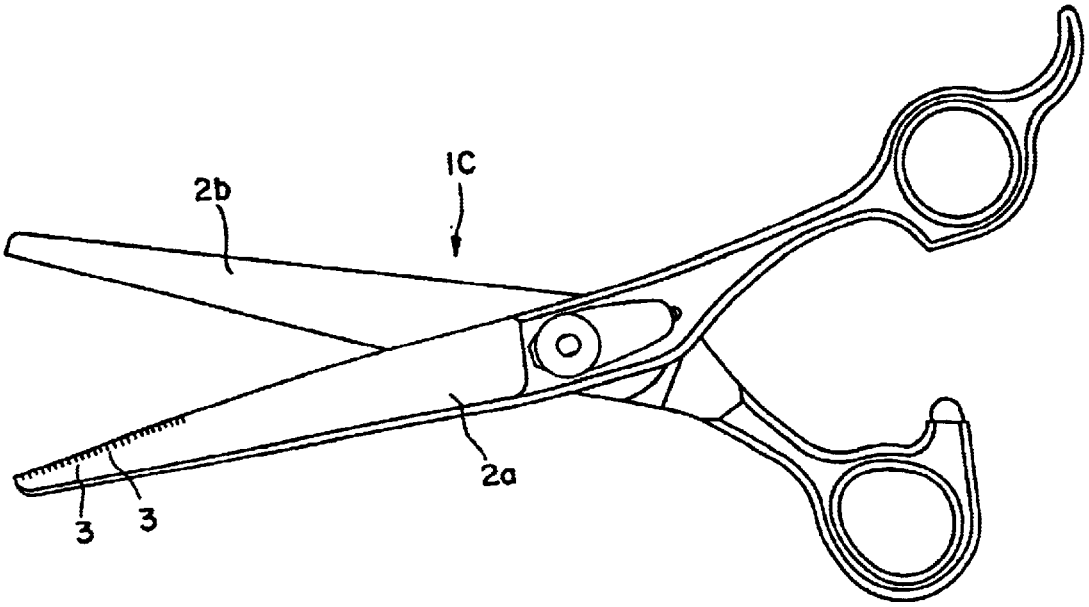
FIG. 18 is a view in which slits are provided only at the point portion of a blade.

As still another example, in cutting shears 1C shown in FIG. 18, slits are provided for only 2 cm to 3 cm at,the point portion of blade 2*a* with equal pitches. The present invention is employed at the point portion that is used most frequently in the cutting shears.

Figure 19:
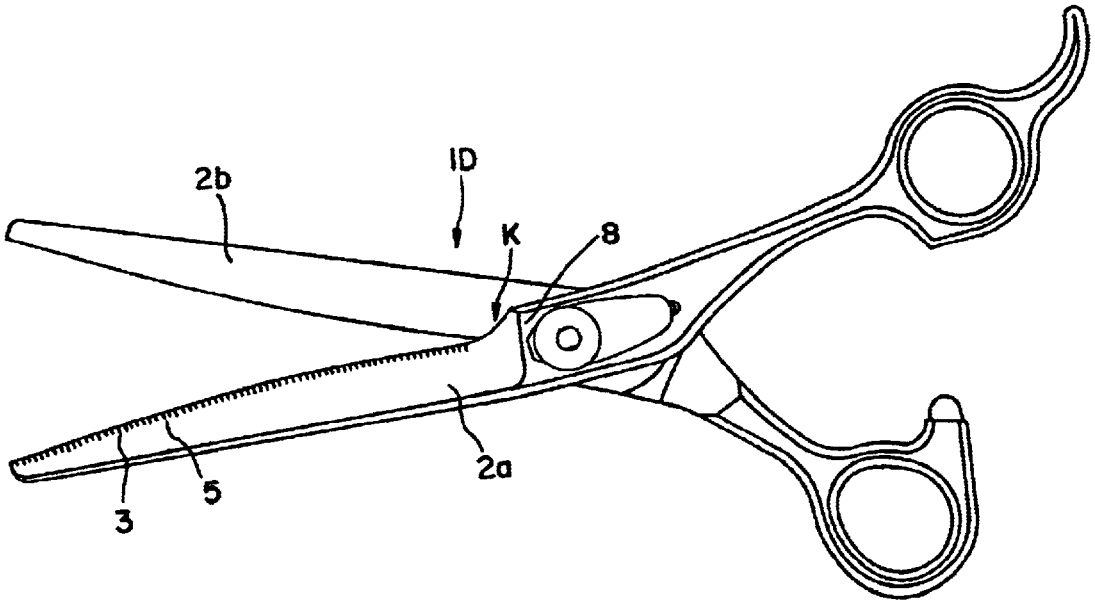
FIG. 19 is a view showing a still another cutting shears according to the present invention.

As still another example, in cutting shears ID shown in FIG. 19, thin slits 3 and thick slits 5 with the same lengths are provided alternately at only blade 2*a*. The shape of the edge line is formed to swell in protrusive manner in the middle portion of the entire blade, and to be set at a position (reference K shown in the figure) retracted from shank 8. Therefore, wherever both of the edge lines caused when the scissors are closed cross from the heel to the point, the same crossing angle can be maintained. As a result, the hair slip characteristics of the cutting shears are comparatively uniform from the heel to the point. When slits are serially provided on the edges with equal pitches, a non-slip effect is comparatively uniform from the heel to the point, and usable scissors are obtained.

Figure 20:
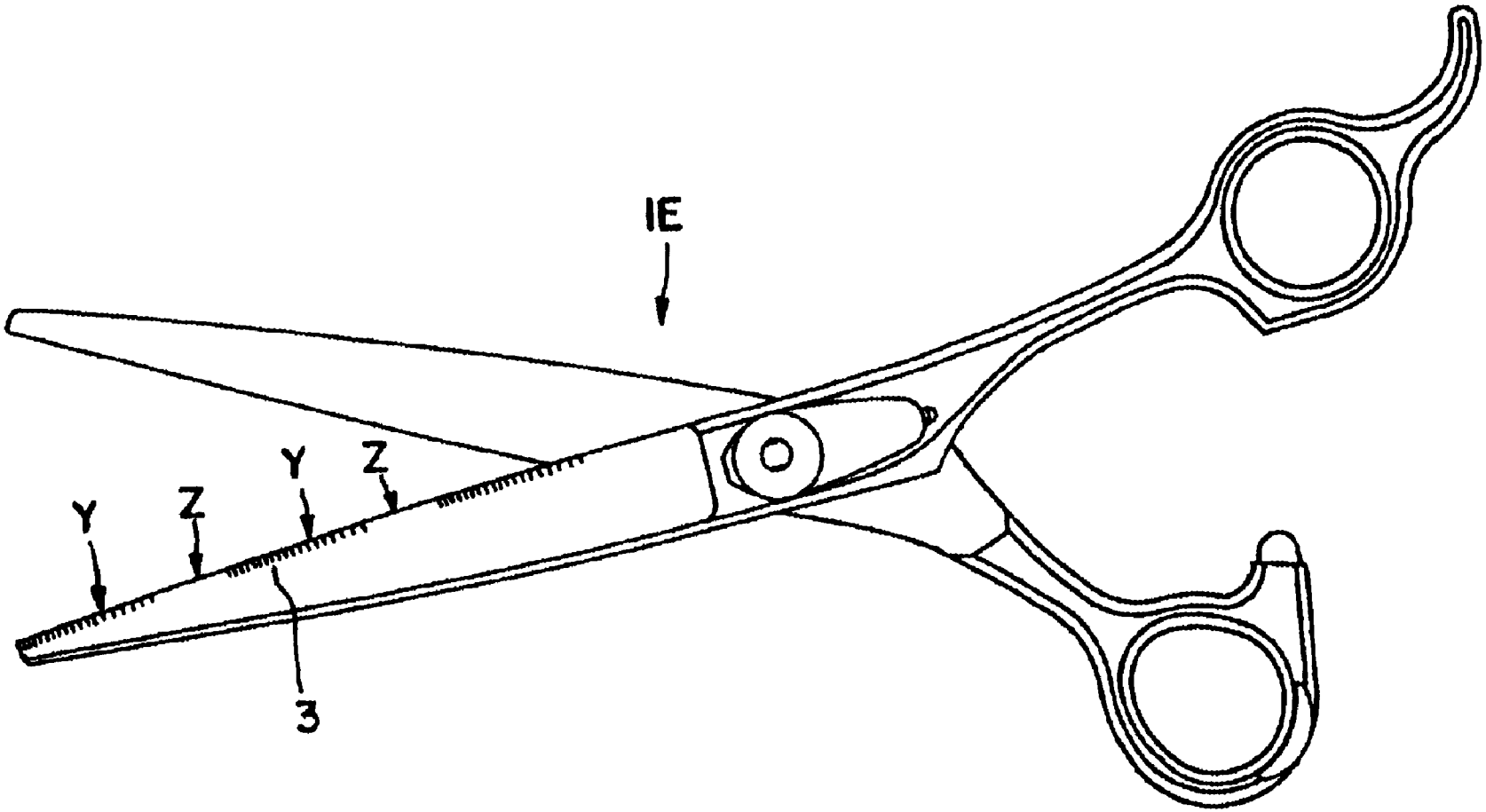
FIG. 20 is a view showing cutting shears, wherein portion Y at which slits serially provided and slit free blade portion Z are repeated alternately, and the large and small gaps at the node of the slit are provided in the continuous portion of one slit.
Figure 21:
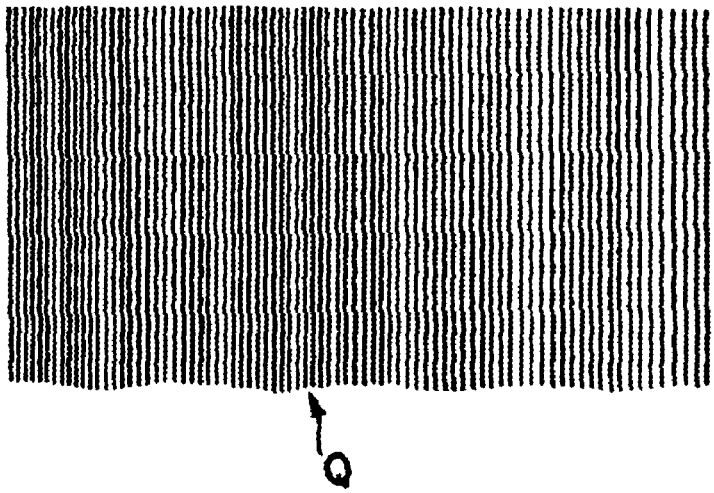
FIG. 21 is a view exemplifying a finish caused by the cutting shears shown in FIG. 20.

As still another example, in FIG. 20, there is shown cutting shears 1E as claimed in claim 7, wherein three portions Y at which slits 3 are serially provided are disposed along the edge, namely portion Y at which slits 3 are serially provided and slit free blade portion Z are repeated. In slits 3, the large and small gaps are provided such that the roughness is provided at a portion close to the heel at one serially provided portion Y and gradually finer toward the point. When cutting shears 1E are used, the cut hair is finished in the form of wave Q, as shown in FIG. 21, and the feeling different from straight line alignment is obtained. The other large and small gaps of each slit may be formed in any shape.

Figure 22:
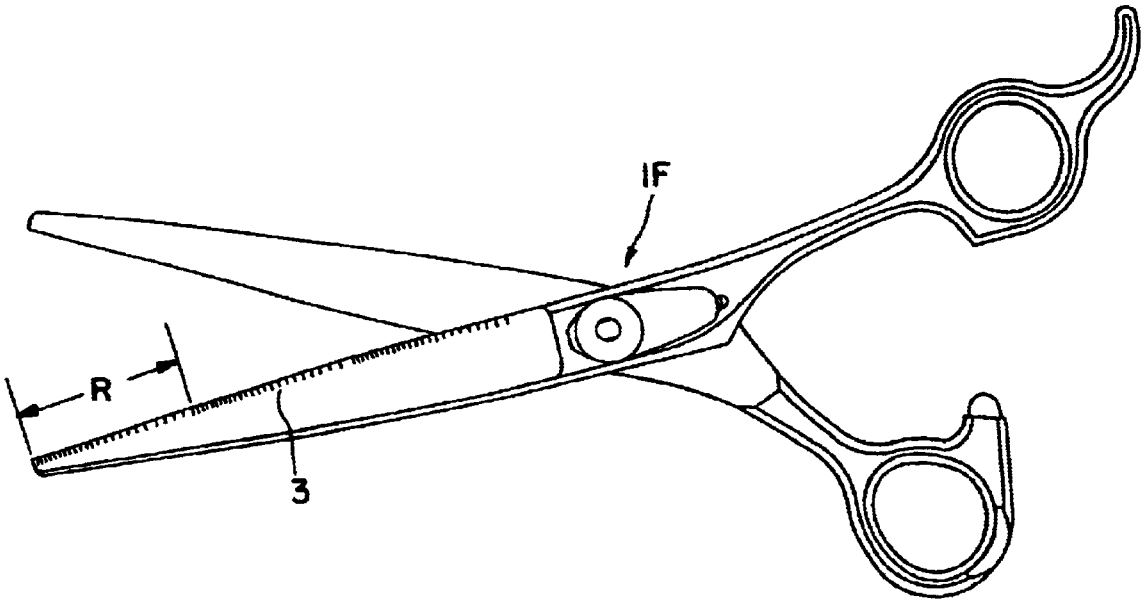
FIG. 22 is a view showing cutting shears, wherein compartments are repeated such that slits are gradually finer from the roughness close to the heel toward the point.

As still another example, in FIG. 22, there is shown cutting shears 1F as claimed in claim 7, wherein portion R, where slits 3 are provided roughly at the portion close to the heel gradually finer toward the point, is repeated three times over the full length of the blade.

Figure 24:
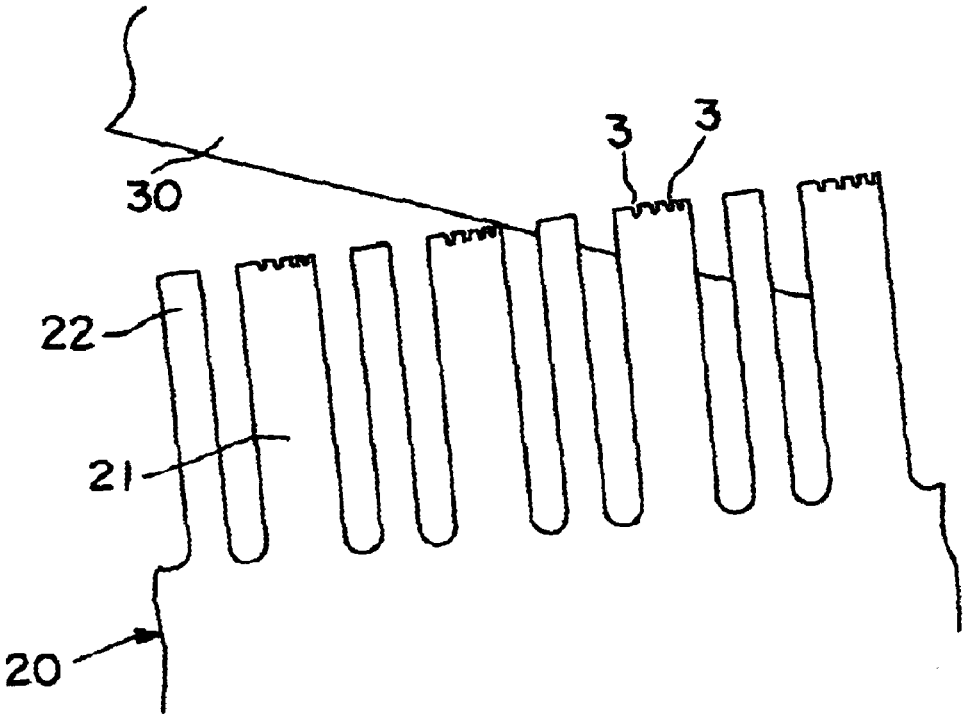
FIG. 24 is a partial enlarged view, of FIG. 23.
Figure 23:
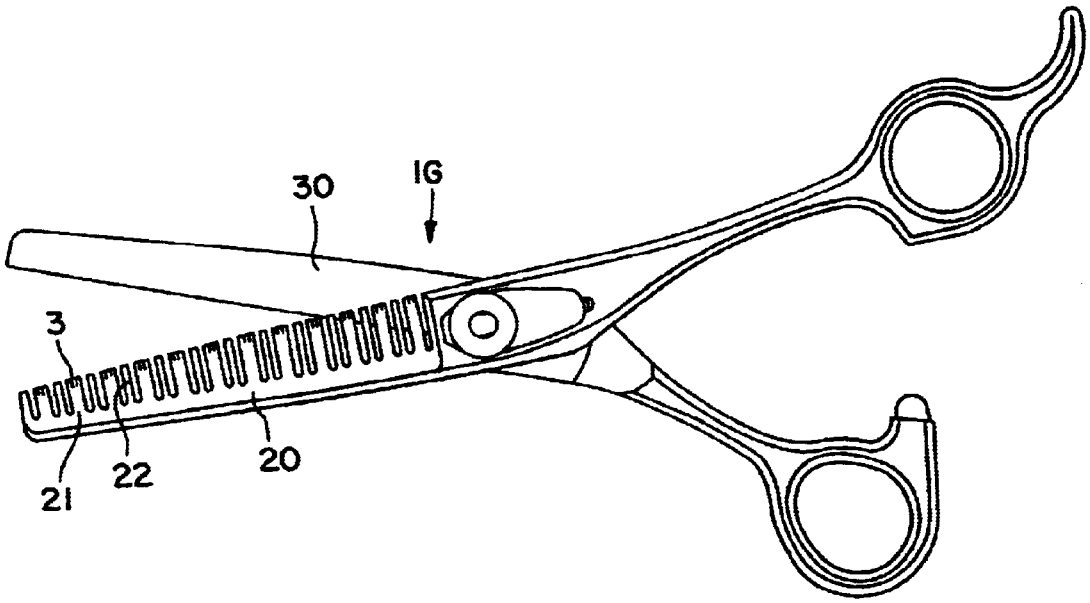
FIG. 23 is a view showing thinning shears according to the present invention, wherein slits are formed at one blade with equal pitches.
Figure 25:
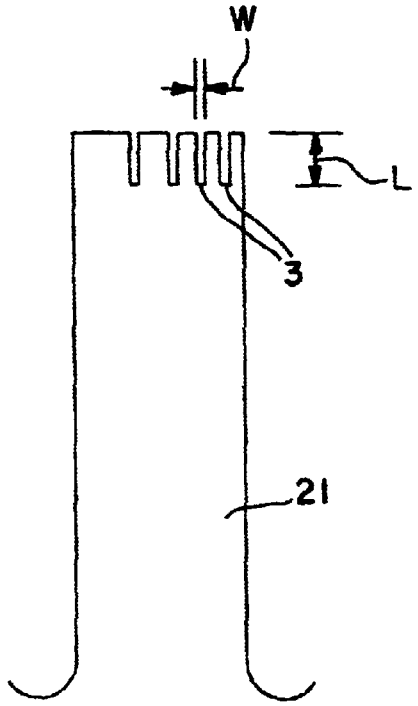
FIG. 25 is a partial enlarged view showing a blade for illustrating a slit.

As still another example, in FIG. 23, there is shown thinning shears 1G to which the present invention is applicable, wherein thinning blade 20 and straight blade 30 are pivoted, and wide thinning blade 21 and narrow thinning blade 22 are provided alternately. In addition, an interval between thinning blades 22 and 22 are equal to another interval. Several slits 3 are provided at wide thinning blade 21, and a slit is not provided at narrow thinning blade 22. Slits 3 are shaped and disposed, as shown in FIG. 24 and FIG. 25, wherein the slit width is defined to be about 0.04 mm to 0.05 mm, and the slit length L is defined to be about 1.0 mm.

Thinning shears 1G are also formed as thinning shears in which hair slip is reduced by the provided slits. When the scissors are closed, there is eliminated a strong resistance when a lock of the hairs caught by the concave ridges at the edge of the thinning blade, enabling smooth closing work.

Slits may be provided at the edge of the straight blade without providing a slit at the thinning blade.

Figure 26:
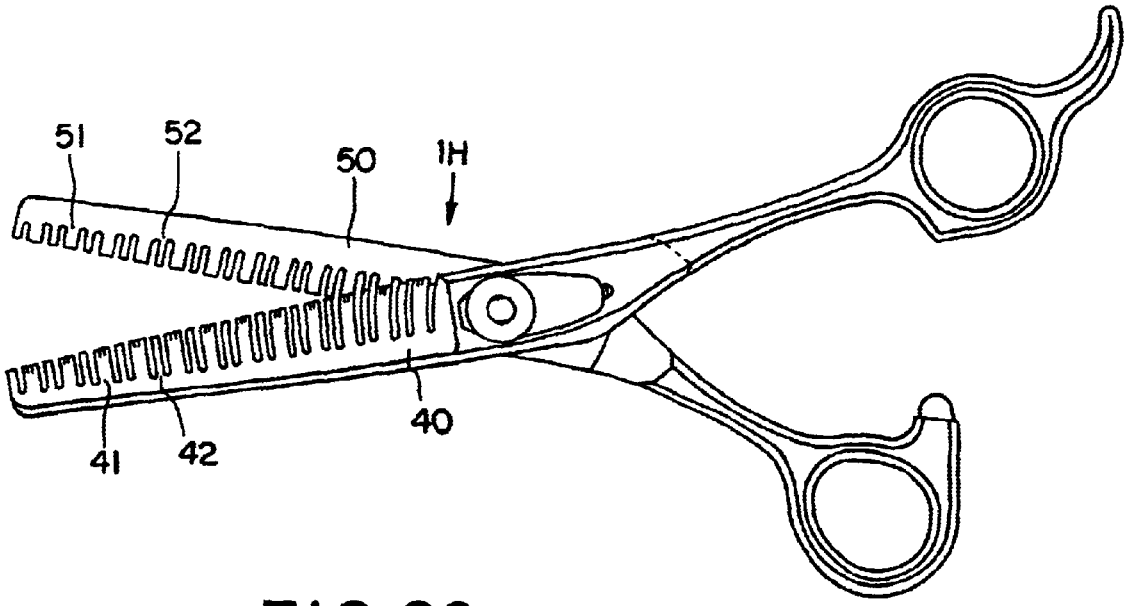
FIG. 26 is a view showing another thinning shears according to the present invention.
Figure 27:
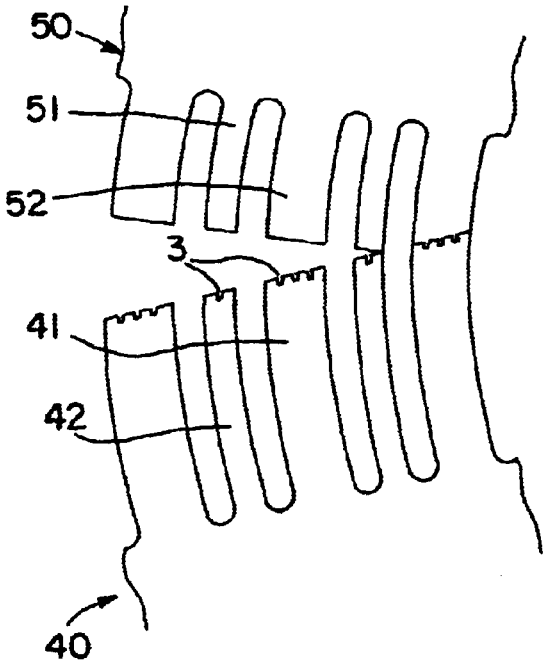
FIG. 27 is a partial enlarged view of FIG. 26.

As still another example, in FIG. 26 and FIG. 27, there is shown thinning shears 1H, wherein two blades each consist of thinning blades 40 and 50. In these thinning blades 40 and 50, their thinning blades 41, 42, 51, and 52 are formed in a concentric shape around the pivot, and wide thinning blades 41 and 51 and narrow thinning blades 42 and 52 are provided to be opposite to each other. The width of the thinning blade 50 that serves as a moving blade (the length from the peak to the point) is narrower than that of thinning blade 40 that serves as a still blade, whereby thinning blades 51 and 52 of the moving blade are formed to be shorter than thinning blades 41 and 42 of the still blade. The intervals of the thinning blades are equal to each other. Slits 3 are provided at the side of the thinning blade 40 that serves as the still blade. Several slits 3 are provided at the wide thinning blade 41, and one slit 3 is provided at the narrow thinning blade 42.

Figure 12:
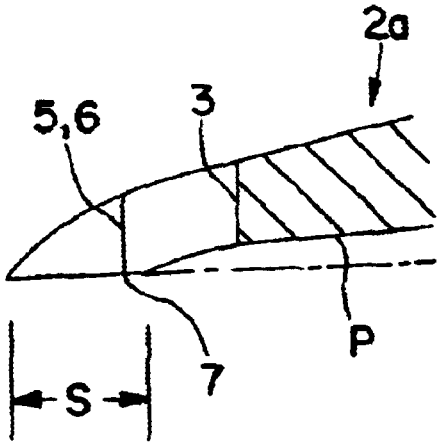
FIG. 12 is a view showing how thin slit 3 and thick slit 5 shown in FIG. 11 are associated with frictional sliding face S and back space P.
Figure 28:
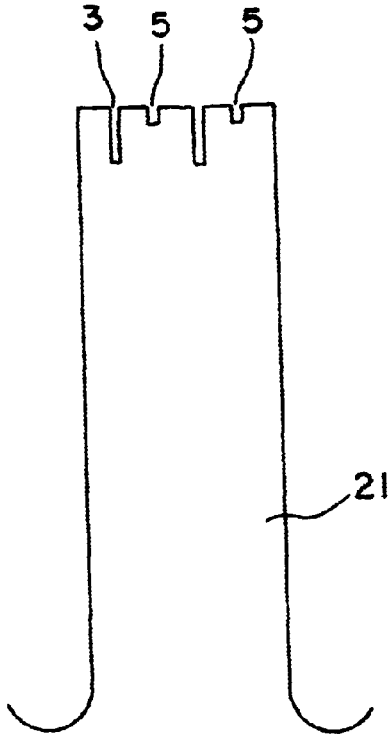
FIG. 28 is a partial enlarged view showing a case in which a thin slit and a thick slit are repeated alternately at the node of the thinning shears with equal pitches.

As still another example, in FIG. 28, there is shown that the slits shown in FIG. 10 to FIG. 12 are applied to thinning shears. This example is the same as the each of foregoing examples in the fact that thin slits 3 and thick slits 5 are formed alternately at the thinning blade with equal pitches, the width and/or length of each slit, and non-slip effect. In addition, this example is also the same as each of the foregoing examples in that blade 7 is formed at slit bottom 6 of thick slit 5, whereby, even if hairs enter the slit, such hairs can be cut.

As a still another example, an example when the invention as claimed in claim 7 is applied to thinning shears is as follows. First, arbitrary disposition of a portion at which slits are serially provided is achieved by properly disposing a thinning blade on which slits are provided and a conventional thinning blade on which a linear edge is provided without providing the slits. In addition, with respect to the large and small gaps of the slits, slits are provided for each thinning blade, and are provided by changing the density of the slits for each thinning blade. Alternatively, in the case of a wide thinning blade (for example, 1 cm in width), the large and small gaps may be provided in such one thinning blade.

Alternatively, in the case where thinning shears consists of a straight blade and a thinning blade, the thinning blade is conventionally kept to be linear at its edge. Further, a serially provided portion is arbitrarily disposed on the side of the straight blade or the large and small gaps of the slits may be provided at the serially provided portion, as in the above mentioned cutting shears.

Depending on such provision of the slits, the thinning shears are divided into a thinning blade by which the hair can be cut without slippage and a thinning blade by which the hair can be cut with slippage. Such difference in slippage is brought onto the edge line. Thus, the hair thinning quantities differ with each portion of the blade, and a natural change can be obtained in finish of hair thinning.

Figure 29:
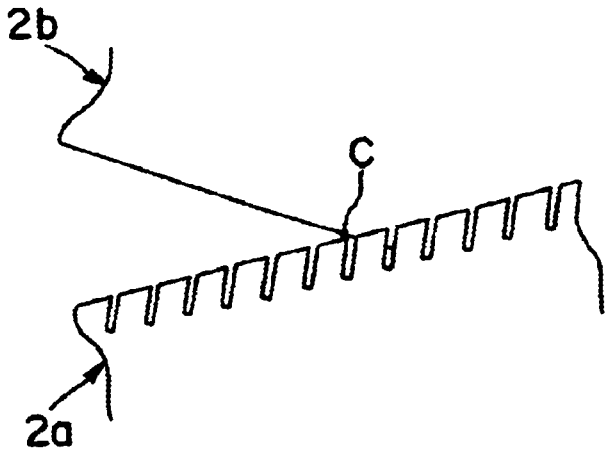
FIG. 29 is a view showing cutting shears, wherein the orientation of a slit is inclined so as to be vertical to the edge line of counterpart blade 2*b* when the scissors are closed.
Figure 30:
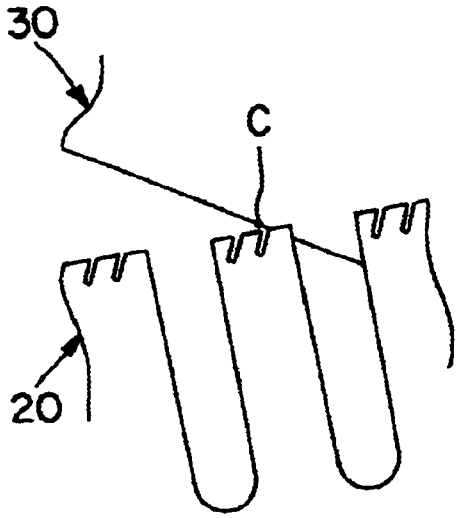
FIG. 30 is a view showing thinning shears, wherein the orientation of the slit is inclined in a manner similar to that shown in FIG. 29.
Figure 31:
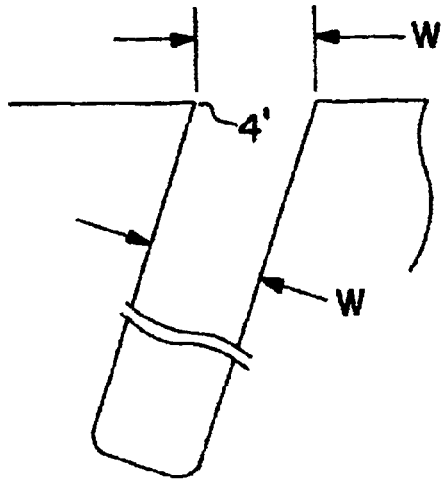
FIG. 31 is an enlarged view showing a slit shown in FIG. 29 and FIG. 30.

In the above described scissors 1A to 1H, although all of the slits are cut out at a substantially right angle relevant to the longitudinal direction of the blade, as shown in FIG. 29 and 30, the slits may be cut out at a predetermined inclined angle relevant to the longitudinal direction of the blades 2*a* and 20. As an example, at each cross point C when the scissors are closed, a respective one of the slits may be provided in a direction vertical to the edge line of the counterpart blades 2*b* and 30. Alternatively, a respective one of the slits maybe provided in angled direction to the direction vertical to the edge line of the counterpart blade 2*b* and 30. In this manner, as shown in FIG. 31, one end 4' of the opening of the slit is acute, a catching effect increases, and a non-slip effect is improved. In addition, since the slit is cut out obliquely, the width W0 of the opening is wider than the slit width W. In this respect as well, a non-slip effect is improved. Further, if a hair is equal to the thickness of the slit width of the slit, such hair easily enters the slit.

Figure 32:
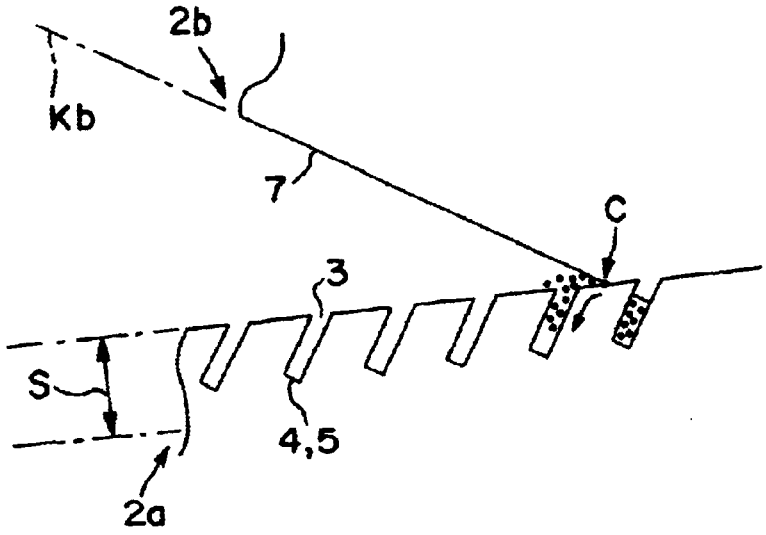
FIG. 32 is a view showing a case in which an inclined slit is defined in width that corresponds to some hairs.

In addition, in the case where the slit width corresponds to the widths of some hairs, it is estimated that such hairs are captured by the slit, and are cut. Thus, as shown in FIG. 32, the hairs can be easily captured by the slit. Further, the hairs that are captured by the slit 3 and enter the slit are arranged in a longitudinal column substantially vertical to the edge of the counterpart blade 2*b*. Thus, cutting can be properly done.

The slit width, mixed disposition of the thin and thick slits, pitch, slit length, the presence or absence of slit, and the large and small gaps of the slit, may be freely determined.

The present invention is also applicable to scissors of blade replacement type. In the scissors of such blade replacement type, a site of the blade of the scissors is provided as a replacement blade independent of the scissors main body, and various types of replacement blades are available depending on the mounting method. At this replacement blade, there is provided a slit that is one of the constituent elements of the present invention. This blade is mounted to the scissors main body, thereby forming the scissors according to the present invention.

Figure 33A:
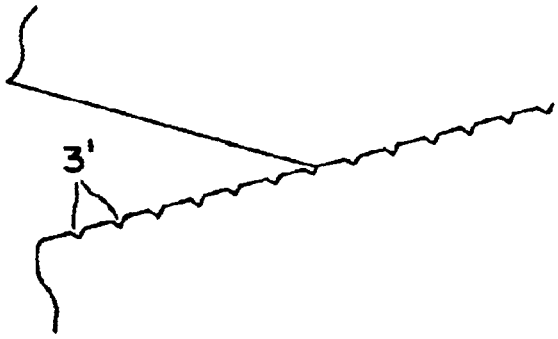
FIG. 33 is a view showing an example when shallowly cutout, substantially concave shaped engagingly fit slits are serially provided in place of a slit.
Figure 33B:
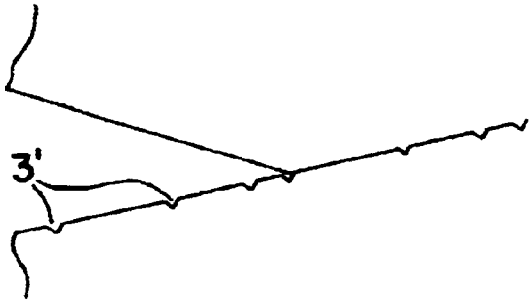
Figure 33C:
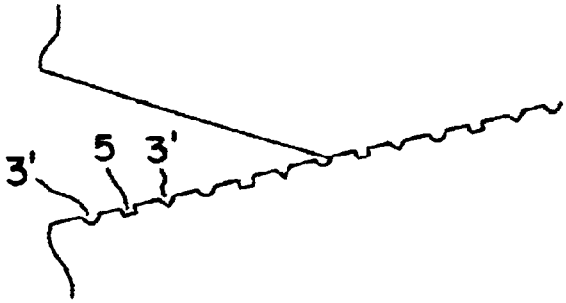
Figure 34:
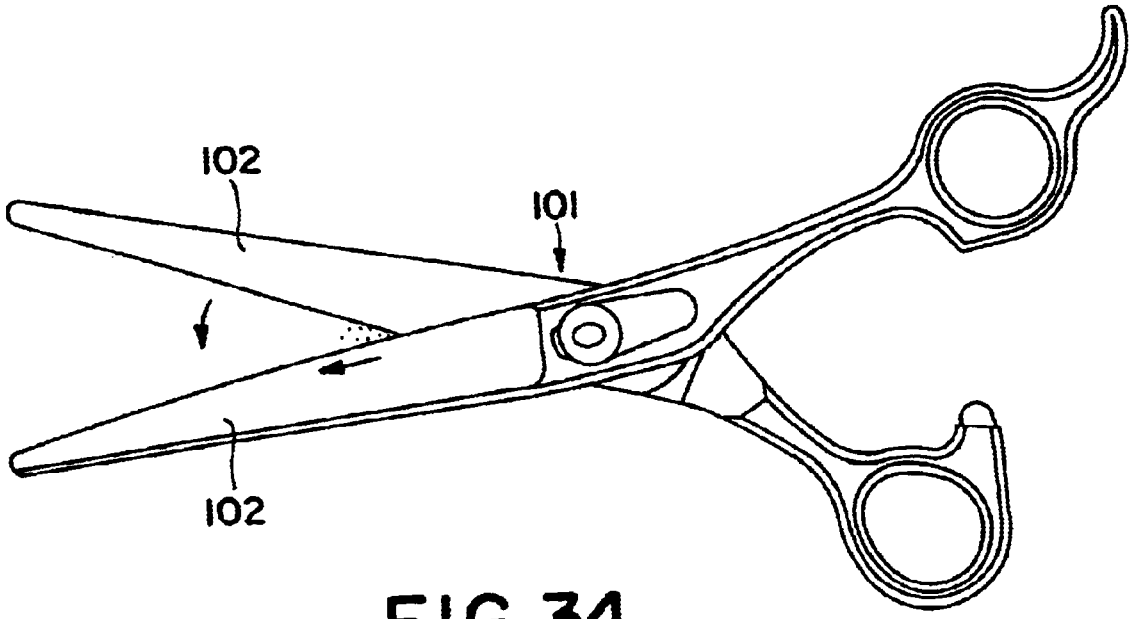
FIG. 34 PRIOR ART
FIG. 34 is a view showing conventional cutting shears, wherein hairs slip.
Figure 36:
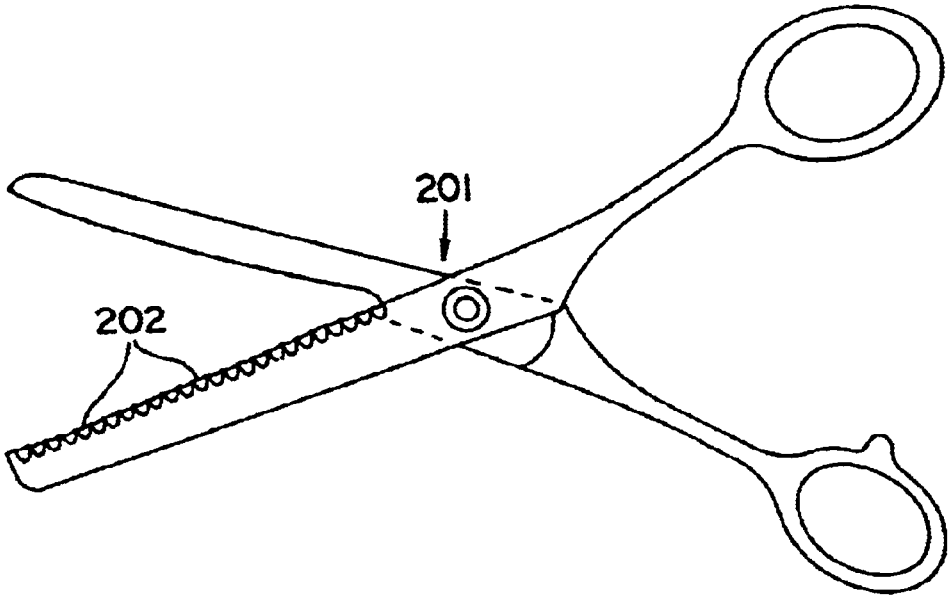
FIG. 36 PRIOR ART
FIG. 36 is a view showing saw scissors that is a type of cutting shears, and that have concave ridges at the edge.
Figure 35:
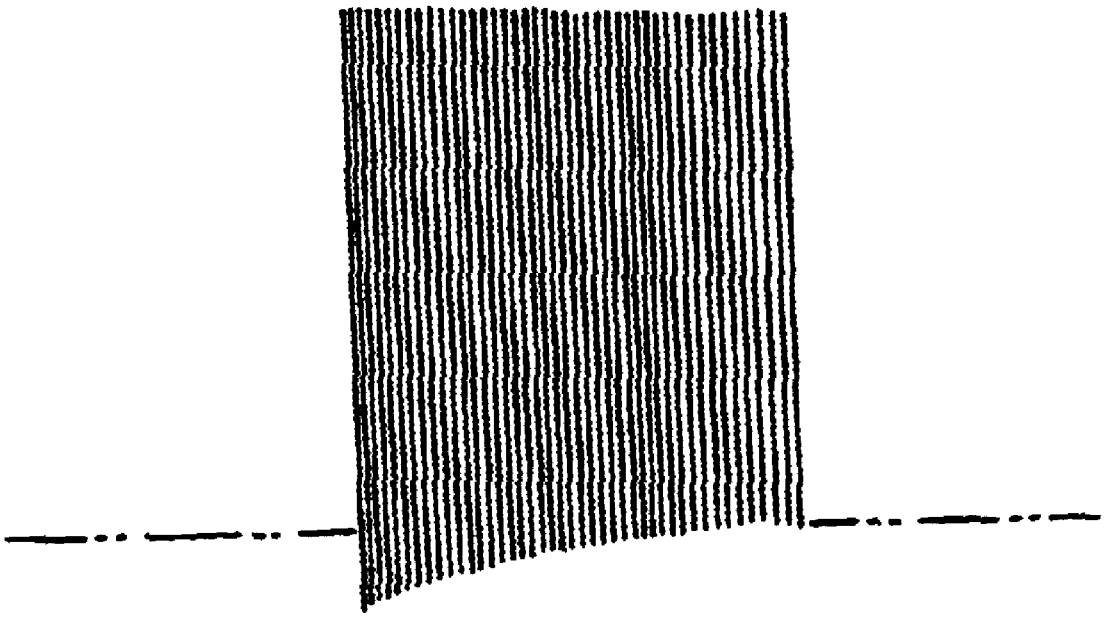
FIG. 35 PRIOR ART
FIG. 35 is a view illustrating a case in which hair cut trace is not aligned in a straight line.
Figure 37:
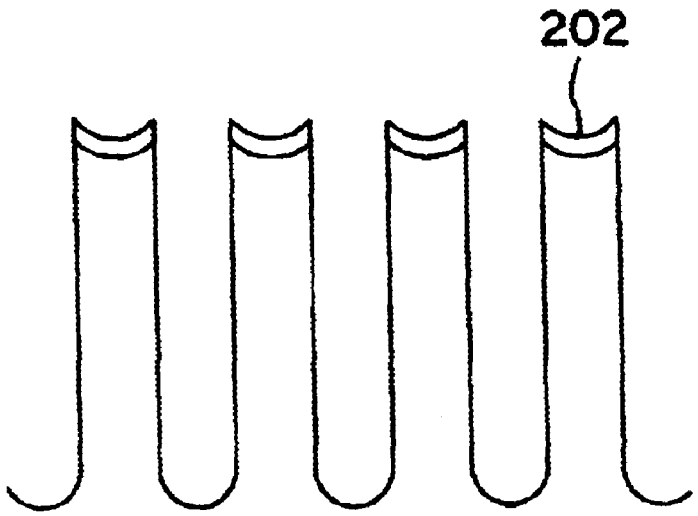
FIG. 37 PRIOR ART
FIG. 37 is a view showing a thinning blade, wherein the edge has U shaped concave ridges.
Figure 38:
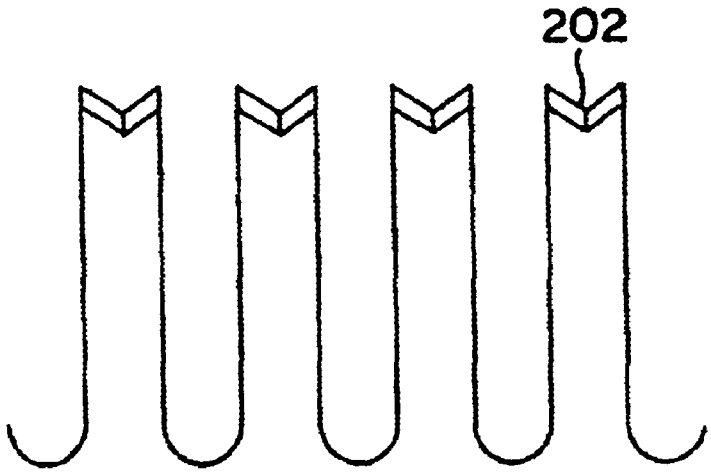
FIG. 38 PRIOR ART
FIG. 38 is a view showing a thinning blade, wherein the edge has V shaped concave ridges.
Figure 39:
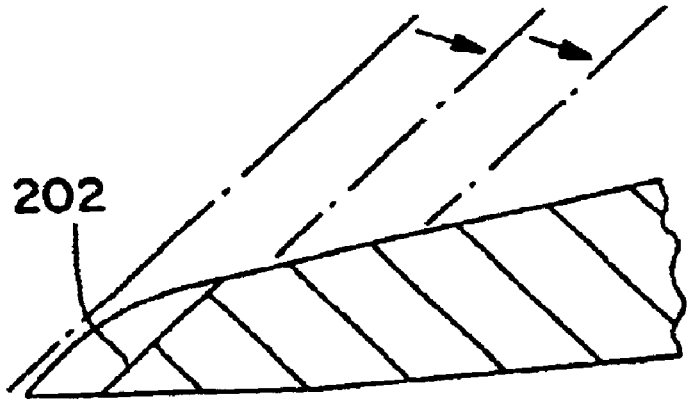
FIG. 39 PRIOR ART
FIG. 39 is a view illustrating the fact that the concave ridges of the edge are eliminated in the scissors shown in FIG. 36 to FIG. 38.
Figure 40:
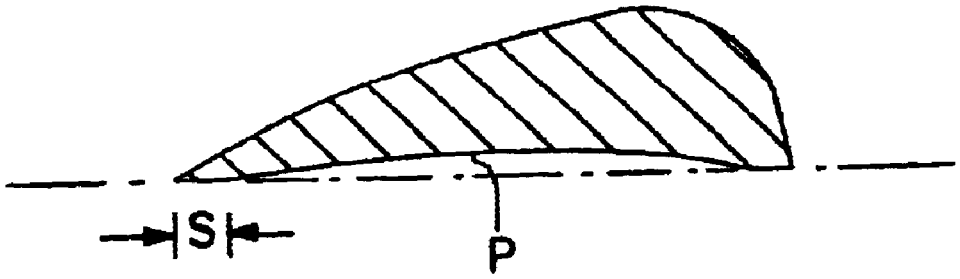
FIG. 40 is a view illustrating frictional sliding face S at the blade back of the scissors.

In the above described scissors, in place of a substantially linear slit, as shown in FIG. 33, shallowly cutout, substantially concave engagingly slits 3' may be serially provided. In this case, an opening width of the engagingly fit 3' corresponds to the slit width of the slit that has been described. A hair is hardly caught by a thin slit 31 that assumes the average thickness of hair, and non-slip does not work well. In such a case as well, a hair is caught by the other thick slit 5, and a non-slip effect is achieved. In this case, the engagingly fit slit 3' disappears comparatively earlier by grinding. These are effectively used for an inexpensive, disposable scissors or can be employed for scissors of blade replacement type. Any manufacturing method may be employed. In the case where a blade can be pressed to be released from a blade material, there is provided a method of pressing the blade and an engagingly fit slit simultaneously. Alternatively, an engagingly fit slit may be additionally provided at a blade that reaches a stage of completion.

What is claimed is:

1. Scissors instrument for cutting hair with a pair of interacting pivoted blades, operative to pivot at least one of the blades relative to the other blade between a fully closed scissors position of fullest advance of blades' forward edges with the blades overlapping as viewed perpendicular to blade side faces, and an open position of retracted blades' forward edges, with a forward blade edge of at least one of the blades having a series of spaced slits having a width under 0.16 mm uniformly over at least most of the slits' series lengths, the blade slits' being constructed and arranged to arrest slippage of hair, and further including in such series of slit groups of both shorter and substantially longer length slits, and wherein the slits of each series of slits are formed in a predetermined slit width in which some hairs enter therein singly as the hair is cut.

2. Scissors instrument for cutting hair with a pair of interacting pivoted blades, operative to pivot at least one of the blades relative to the other blade between a fully closed scissors position of fullest advance of blades' forward edges with both the blades' forward edges overlapping as viewed perpendicular to blade side faces, and an open position of retracted blades' forward edges, with a forward blade edge of at least one of the blades having a series of spaced slits having a width under 0.16 mm uniformly over at least most of the slits' lengths, the blade slits being constructed and arranged to arrest slippage of hair and further including in such series of slits groups of both shorter and substantially longer length slits.

3. Scissors instrument for cutting hair with a pair of interacting pivoted blades, operative to pivot at least one of the blades relative to the other blade between a fully closed scissors position of fullest advance of blades' forward edges with both the blades' forward edges overlapping as viewed perpendicular to blade side faces, and an open position of retracted blades' forward edges, with a forward blade edge of at least one of the blades having a series of spaced slits having a width under 0.16 mm uniformly over at least most of the slits' lengths, the blade slits being constructed and arranged to arrest slippage of hair and further including, in such series of slits, groups of both shorter and substantially longer length slits and wherein a direction in which the longer slits are cut out is provided in a direction substantially vertical to the forward edge of the other blade.

4. Scissors instrument as claimed in claim 3 wherein a plurality of series of slits is provided and at least one such series which the slits are serially provided has large and small gaps between slits.

5. Scissors instrument as claimed in claim 3 wherein the slits of at least one such are of different widths so that the relatively wider slits achieve non-slip effect if the narrower ones do not.

6. Scissors instrument for cutting hair with a pair of interacting blades each having an edge, the edge of at least a first one of said blades comprising one or more series of non-slip slits and one or more straight hair cutting edge portions provided between said series of slits, wherein the other (second) blade has one or more straight hair cutting edge portions of substantial length that correspond to at least one of the sales of slits of the edge of the first blade, for cutting hair between the edges of said interacting blades, including some cutting where the edge of one blade cuts hair held at slits of the edge of the other blade and the width of each slit is no greater than 0.16 mm.

7. The scissors instrument of claim 6, constructed and arranged so that the width of each slit is no greater than the thickness of the hair to be cut.

8. The scissors instrument of claim 6, wherein the slits on one blade are provided such that a straight edge portion of the other blade respectively meets said slits substantially at right angles.

9. The scissors instrument of claim 6, wherein the slits are arranged at irregular intervals.

10. The scissors instrument of claim 6, wherein the slits are arranged in a predetermined pattern.

11. The scissors instrument of claim 6, wherein the slits are shallow cutouts.

12. The scissors instrument of claim 6, wherein each blade is made of a material of 720 Hv or more in hardness.

13. The scissors instrument of claim 12, wherein the material is a hard tool material.

14. The scissors instrument of claim 12, wherein the blades are made of materials having different hardness, and the slits are provided on the harder blade.

* * * * *